US011649692B2

(12) United States Patent
Al-Somali et al.

(10) Patent No.: US 11,649,692 B2
(45) Date of Patent: May 16, 2023

(54) SYSTEM AND METHOD FOR CEMENTING A WELLBORE

(71) Applicant: Saudi Arabian Oil Company, Dhahran (SA)

(72) Inventors: Abdulaziz Al-Somali, Dhahran (SA); Ossama Sehsah, Dhahran (SA); Tariq Al-Talhi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 241 days.

(21) Appl. No.: 16/928,250

(22) Filed: Jul. 14, 2020

(65) Prior Publication Data

US 2022/0018212 A1 Jan. 20, 2022

(51) Int. Cl.

| | |
|---|---|
| ***E21B 33/14*** | (2006.01) |
| ***E21B 47/005*** | (2012.01) |
| ***E21B 47/06*** | (2012.01) |
| ***E21B 47/07*** | (2012.01) |
| ***E21B 47/18*** | (2012.01) |

(52) U.S. Cl.

CPC ..... *E21B 33/14* (2013.01); *E21B 47/005* (2020.05); *E21B 47/06* (2013.01); *E21B 47/07* (2020.05); *E21B 47/18* (2013.01)

(58) Field of Classification Search

CPC ..... E21B 33/14; E21B 47/005; E21B 47/06; E21B 47/07; E21B 47/18

See application file for complete search history.

(56) References Cited

U.S. PATENT DOCUMENTS

| | | | | |
|---|---|---|---|---|
| 6,176,323 | B1 * | 1/2001 | Weirich | E21B 49/005 175/40 |
| 6,209,638 | B1 | 4/2001 | Mikolajczyk | |
| 6,429,784 | B1 | 8/2002 | Beique et al. | |
| 6,634,425 | B2 * | 10/2003 | King | E21B 47/12 166/250.14 |
| 6,802,373 | B2 * | 10/2004 | Dillenbeck | E21B 33/05 166/250.14 |
| 6,847,034 | B2 * | 1/2005 | Shah | E21B 47/135 250/227.27 |
| 7,252,152 | B2 * | 8/2007 | LoGiudice | E21B 34/066 166/250.14 |
| 8,083,849 | B2 | 12/2011 | Lewis et al. | |
| 8,172,007 | B2 * | 5/2012 | Dolman | E21B 47/11 166/250.11 |

(Continued)

*Primary Examiner* — Matthew R Buck

(74) *Attorney, Agent, or Firm* — Bracewell LLP; Constance G. Rhebergen; Keith R. Derrington

(57) ABSTRACT

Before, during, and after a wellbore cementing operation temperature, pressure, and other conditions of a cement slurry are monitored downhole. The monitored conditions are compared to theoretical or calculated conditions to confirm the cementing operation is carried out in downhole conditions as planned. When differences between the monitored conditions and those used in planning the cementing operation exceed an acceptable range, adjustments are made to the cementing operation to account for the differences. The adjustments include changing a composition of the cement slurry to increase its design temperature, wellbore intervention if monitored pressure reveals a backflow of cement, and proceeding with another cementing stage if the monitored conditions indicate the cement slurry has cured into a set cement.

19 Claims, 5 Drawing Sheets

(56) References Cited

U.S. PATENT DOCUMENTS

| | | | | |
|---|---|---|---|---|
| 8,302,686 | B2 | 11/2012 | Roddy et al. | |
| 8,436,743 | B2 * | 5/2013 | Auzerais | E21B 33/16 340/854.7 |
| 9,404,617 | B2 | 8/2016 | Sartiaux et al. | |
| 9,708,904 | B2 | 7/2017 | McGarian et al. | |
| 10,253,625 | B2 | 4/2019 | Williams et al. | |
| 11,085,287 | B2 * | 8/2021 | Hjulstad | E21B 47/005 |
| 2014/0083177 | A1 | 3/2014 | Utter et al. | |
| 2017/0002622 | A1 * | 1/2017 | De Bruijn | E21B 33/14 |
| 2017/0167223 | A1 * | 6/2017 | James | E21B 33/14 |
| 2021/0207470 | A1 * | 7/2021 | Pisklak | G01N 23/20091 |
| 2021/0238978 | A1 * | 8/2021 | Singh | G01V 1/52 |
| 2022/0010190 | A1 * | 1/2022 | Singh | C04B 28/02 |

* cited by examiner

SYSTEM AND METHOD FOR CEMENTING A WELLBORE

BACKGROUND OF THE INVENTION

1. Field of Invention

The present disclosure relates to actively monitoring downhole conditions during wellbore cementing operations, and selectively adjusting cementing operations based on data obtained during monitoring.

2. Description of Prior Art

Hydrocarbons that are produced from subterranean formations typically flow from the formation to surface via wellbores that are drilled from surface and intersect the formation. The wellbores are often lined with a casing string which is usually bonded to the inner surface of the wellbore with a wellbore cement. In addition to anchoring the casing within the wellbore, the cement also isolates adjacent zones within the formation from one another. Without the cement isolating these adjacent zones a potential exists for communication of gaseous formation fluids through cracks and microannuli. This gas communication can cause pressure buildup behind the casing to possibly reduce the hydrocarbon producing potential of the wellbore.

Cementing operations typically involve depositing a designated amount of cement slurry into the casing string, forcing the cement slurry through the casing string causing the slurry to exit from a lower end of the casing string and to then flow back up into the annulus between the casing string and walls of the wellbore. A technique used to estimate what amount of cement slurry to deposit into the casing is based on the annulus volume in which the cement is being injected. To force the cement slurry downward through and from the casing string, and then upward in the annulus; a plug is landed on top of the cement slurry column, and pressurized fluid is added into the casing string above the plug to push the plug, and the cement slurry, downward through the casing string. A cement shoe is often provided at the lowermost end of the casing string, and which the plug latches to when it reaches a lower end of the casing string. Temperature downhole where the cement slurry exits the casing string is typically derived from historical data from the field, and values of pressure are generally based on static head calculations.

SUMMARY OF THE INVENTION

An example method of cementing a wellbore is disclosed and that includes flowing a cement slurry into a casing string that is disposed in the wellbore, urging the cement slurry from an end of the casing string and into an annulus between the casing string and walls of the wellbore, obtaining real time downhole conditions of the cement slurry by monitoring conditions of the cement slurry proximate the end, and adjusting a characteristic of the cement slurry based on the downhole conditions. Examples of conditions include pressure and temperature, and examples of monitoring are inside and outside of a shoe track that is disposed on a lower end of the casing string. In this example and where wherein the conditions are pressure and the method further optionally includes identifying a pressure differential of cement slurry flowing through the shoe track. In an example, the method further includes transmitting acoustic signals uphole that represent the monitored conditions and in an alternative includes evaluating a characteristic of the acoustic signals. A property of the cement slurry based on a characteristic of the acoustic signal and the monitored conditions is optionally performed. The method further includes the option of comparing the monitored conditions to expected conditions, and adjusting a design temperature of the cement slurry when the monitored conditions differ from the expected conditions by an amount that exceeds a designated amount. In an example, determining that the cement slurry has cured into a set cement is based on an evaluation of the real time downhole conditions. An evaluation of the holdup of a column of the cement slurry by the shoe track is optionally based on an evaluation of the real time downhole conditions. Downhole intervention is optionally performed to repair the shoe track when no holdup of the column of the cement slurry by the shoe track is determined.

Also disclosed is a system for cementing a wellbore that includes a casing string, a shoe track mounted on an end of the casing string, and that includes a monitoring system that is sensitive to downhole conditions proximate the shoe track, and a means for evaluating that a variance between the downhole conditions and expected conditions exceeds a designated amount, and for identifying an operational adjustment in response to when the variance exceeds the designated amount. An example means is a controller that is in communication with the sensor. The monitoring system optionally has sensors that are inside and outside of the shoe track. The monitoring system alternatively has a sensor that senses the downhole conditions and a transmitter in communication with the sensor. Transmitters are optionally include that are both inside and outside the shoe track. Examples exist where the controller is in communication with the first and second transmitters, and based on a comparison of signals received from the first and second transmitters selectively evaluates characteristics of substances inside the casing string and in an annulus between the casing string and wellbore.

BRIEF DESCRIPTION OF DRAWINGS

Some of the features and benefits of the present invention having been stated, others will become apparent as the description proceeds when taken in conjunction with the accompanying drawings, in which.

Figure 1:
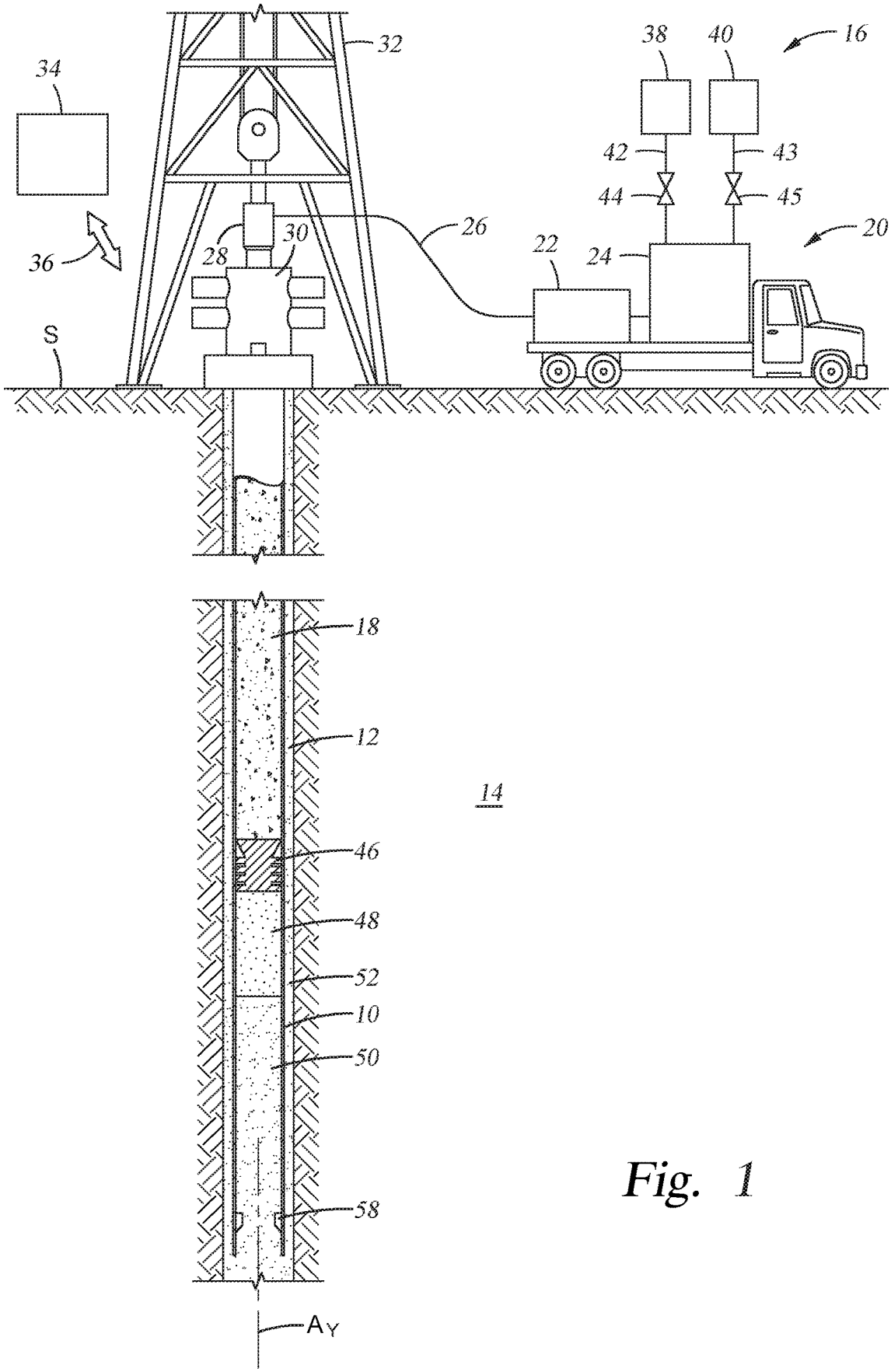
FIGS. 1-3 are partial side sectional views of example steps of cementing a casing string in a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

An example of a wellbore cementing operation is shown in a partial side sectional view in FIG. 1. In this example, a casing string 10 is shown inserted within a wellbore 12 that is formed within a formation 14. An example of a cementing system 16 is shown injecting cement slurry 18 inside casing string 10, and which flows along an axis Ax of casing string 10. A service truck 20 is included with the cementing system 16 that is shown on surface S and equipped with a pump 22 having a suction side in fluid communication with a reservoir 24, and a discharge side connected to a line 26. An end of line 26 opposite pump 22 connects to a cement head 28 shown coupled to a wellhead assembly 30, which in an example provides pressure control of and access into wellbore 12. Further in this example, casing string 10 has an upper end in fluid communication with cement head 28 through wellhead assembly 30, and is supported on its upper end to wellhead assembly 30 by hangers (not shown). A derrick 32 is illustrated mounted on surface S over wellhead assembly 30, and which alternatively provides a framework for mounting the hardware used in the cementing operation.

Cementing system 16 of FIG. 1 includes a controller 34 and a communication means 36 for communicating with controller 34. As will be described in more detail below, in an embodiment controller 34 includes logics for performing calculations, for evaluating operations, and actions to be taken based upon the evaluated and monitored conditions. Optional vessels 38, 40 are schematically represented in communication with slurry reservoir 24 on service truck 20 via lines 42, 43. In one example vessel 38 contains liquid constituents of the cement slurry 18, such as water, and vessel 40 contains solid constituents of the cement slurry 18 (or vice versa), such as but not limited to Portland cement, silica, silicates and the like. Optionally, vessel 38 contains a typical cement slurry 18 and vessel 40 contains additives (or vice versa), such as but not limited to additives for changing design temperature of the cement slurry 18, additives for changing design pressure of the cement slurry 18, agents for accelerating or slowing the rate of curing, additives for mitigating fluid loss, and the like. In a non-limiting example, valves 44, 45 within lines 42, 43 are selectively operated to adjust the compositional makeup of the cement slurry 18, such as when vessels 38, 40 contain constituents of the cement slurry 18. In another example, valves 44, 45 within lines 42, 43 are selectively operated to adjust characteristics or properties of the cement slurry 18, such as when one of the vessels 38, 40 contains an additive. In further embodiments additional vessels are included for storing and the selective dispersal of additives and/or constituents of cement slurry 18.

Figure 2:
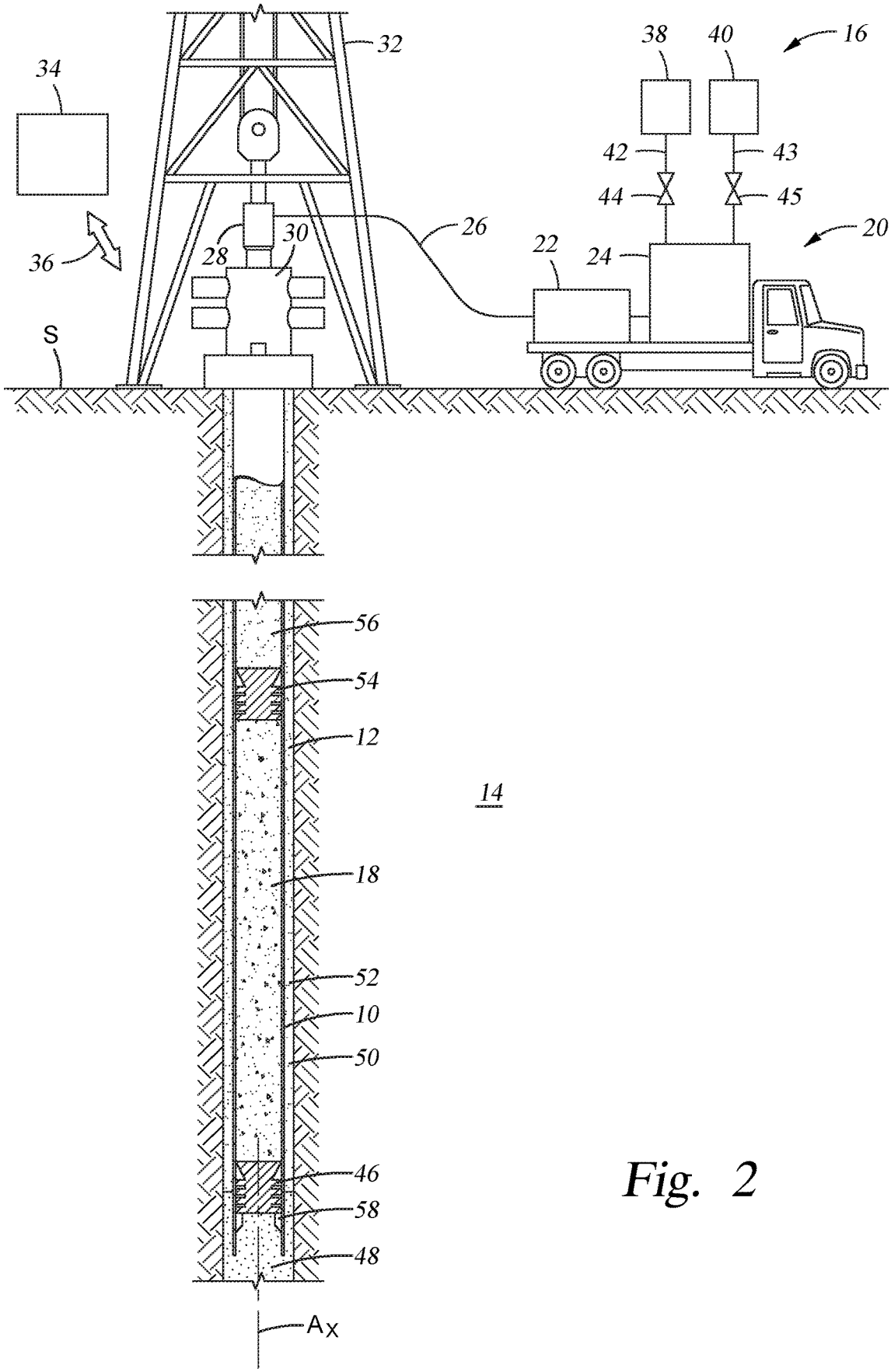

Still referring to FIG. 1, in the example step of cementing illustrated a plug 46 is shown on a lower end of a column of cement slurry 18 inside casing string 10. Plug 46 operates as a barrier between the cement slurry 18 and an amount of spacer fluid 48 below plug 46 and between drilling fluid 50 that is within casing string 10. Urging the cement slurry 18 downward within casing string 10 pushes the drilling fluid 50 from within casing string 10 and out into an annulus 52 between casing string 10 and walls of wellbore 12. A subsequent step of the example cementing operation is shown in FIG. 2 and where the designated amount of the cement slurry 18 has been directed into casing string 10, and inserted into casing string 10 is an upper plug 54 shown disposed on an upper end of the column of the cement slurry 18. A displacement fluid 56 is illustrated on top of the upper plug 54, which similarly to previous steps of the operation is pressurized to urge the upper plug 54 and cement slurry 18 downward within casing string 10. As shown in FIG. 2 lower plug 46 is depicted having been pushed into engagement with a shoe track 58. In the example of FIG. 2 shoe track 58 makes up a lowermost portion of casing string 10.

Figure 3:
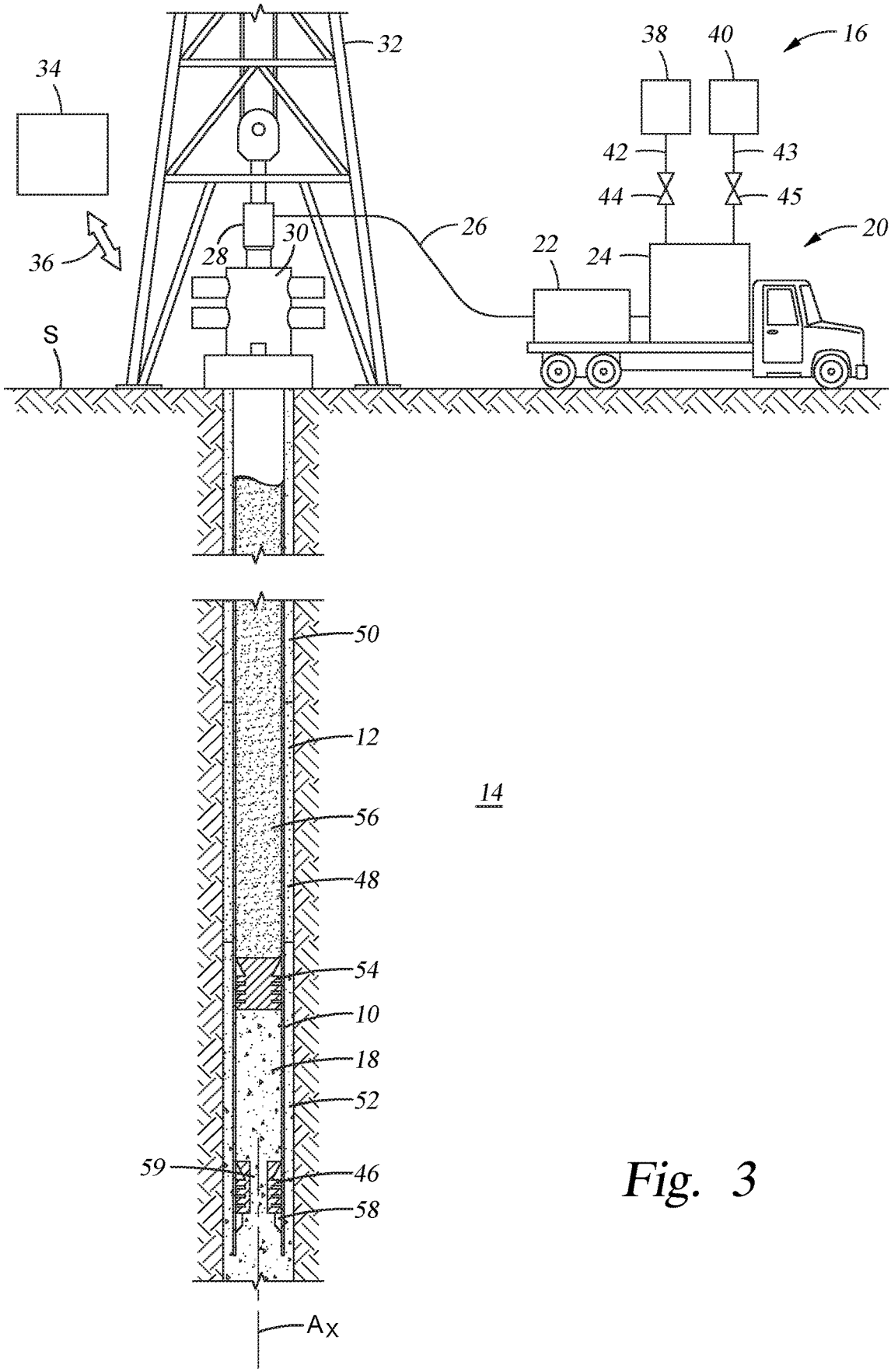

Referring now to FIG. 3, an orifice 59 is shown extending axially through lower plug 46; which is formed by applying pressure to lower plug 46 above a set pressure at which a frangible section in plug 46 ruptures. Forming the orifice 59 through the lower plug 46 allows cement slurry 18 between plugs 54, 46 to flow past the lower plug 46, out from the bottom end of casing string 10, and out into the annulus 52.

Figure 4:
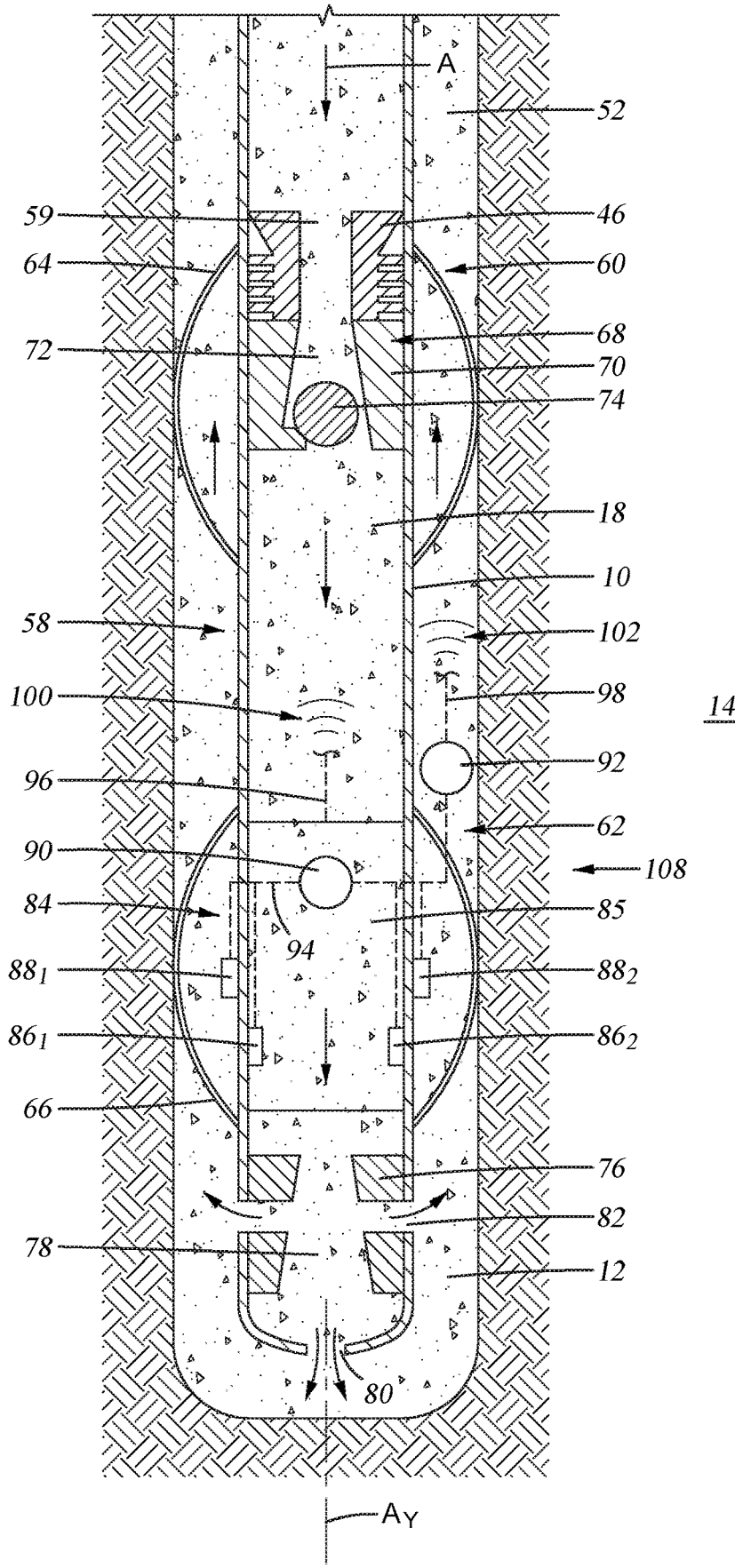
FIG. 4 is a side sectional detail view of a portion of the casing string of FIG. 2.

A detailed example portion of casing string 10 is shown in side sectional view in FIG. 4 where cement slurry 18 is illustrated being forced outward from the bottom end of the shoe track 58. In this example, shoe track 58 is shown having a float collar 60 on which the lower plug 46 is landed and float shoe 62 proximate a lower end of the shoe track 58. Examples of centralizers 64, 66 are shown optionally provided along out surfaces of the shoe track 58, centralizers 64, 66 are respectively disposed adjacent the float collar 60 and float shoe 62; in an alternative an axis $A_Y$ of shoe track 58 is aligned with an axis of wellbore 12 by centralizers 64, 66. In the illustrated embodiment, an example of a check valve assembly 68 is depicted within the float collar 60 and which includes a body 70 within the housing of float collar 60. As illustrated by arrows A, cement slurry 18 flows from casing string 10 into shoe track 58 and into orifice 59 of lower plug 46. An axial passage 72 inside body 70 provides a way for the cement slurry 18 to flow through the body 70 and downward to the float shoe 62. A plug member 74 is axially moveable within passage 72, and that allows flow in a downward direction from float collar 60 to float shoe 62, and as described in more detail below becomes a barrier to upward flow inside the shoe track 58 in a direction from float shoe 62 to float collar 60. In the example shown float shoe 62 includes an inner body 76 having a chamber 78 formed within that is in communication with the inside of shoe track 58 upstream of float shoe 62. A lower port 80 and side port 82 extend through the inner body 76 that provide communication between chamber 78 and annulus 52, so that the inside of the shoe track 58 is in communication with the annulus 52. In this example, the flow of the cement slurry 18 as represented by arrows A illustrates the slurry flowing through the passage 72, and exiting from within the shoe track 58 via ports 80, 82.

A sensor sub 84 is included with the example shoe track 58 and shown disposed axially between the float collar 60 and float shoe 62. An annular space 85 inside of sensor sub 84 is in communication with float collar 60 and float shoe 62, and cement slurry 18 flowing downward from float collar 60 flows through annular space 85 on its way to float shoe 62. Sensor sub 84 of FIG. 4 is equipped with inner sensors $\mathbf{86}_{1,2}$ and outer sensors $88_{1,2}$; where inner sensors $86_{1,2}$ are shown mounted to an inner sidewall of the sensor sub 84 and within annular space 85, and outer sensors $88_{1,2}$ are illustrated mounted to an outer surface of the sensor sub 84 and within annulus 52. In a non-limiting example, inner sensors $86_{1,2}$ sense conditions within annular space 85 and outer sensors $88_{1,2}$ sense conditions within annulus 52. Embodiments exist where conditions within the annular space 85 are the same or substantially the same as conditions within the remaining portions of the shoe track 58. Example downhole conditions monitored by the sensors $86_{1,2}$, $88_{1,2}$ include temperature and pressure, alternatives exist where the conditions monitored by sensors $86_{1,2}$, $88_{1,2}$ represent conditions of the cement slurry 18 inside shoe track 58 and also inside annulus 52.

Further shown in the example of FIG. 4 are inner and outer transmitters 90, 92. Inner transmitter 90 is illustrated disposed inside of the sensor sub 84, and outer transmitter 92 is depicted in the annulus 52 and outside of sensor sub 84. Schematically shown are communication means 94 between inner sensors $86_{1,2}$ and outer sensors $88_{1,2}$ and with each of the transmitters 90, 92. In the example shown, the communication means 94 is a communication line that optionally is made up of media that conducts electromagnetic energy; such as metal wire, or media transmissive by electromagnetic energy, such as fiber optics. In additional embodiments communication means is via wireless telemetry, such as electromagnetic and/or acoustic. Communication lines 96, 98 are provided that connect respectively with transmitters 90, 92 and that in one example provide a communication means between the transmitters 90, 92 and surface S (FIG. 1). Alternatively, as depicted by the acoustic signals 100, 102 communication between the transmitters 90, 92 and surface S takes place acoustically in the form of these signals. Optionally, the signals both in the lines 96, 98 and the acoustic signals 100, 102 are representative of the conditions monitored downhole by the sensors $86_{1,2}$, $88_{1,2}$ so that conditions within shoe track 58 and annulus 52 are available at surface S via communication between sensors $86_{1,2}$, $88_{1,2}$, transmitters 90, 92, and surface S.

In a non-limiting example of operation, signals are transmitted uphole and to controller 34 (FIG. 1) via transmitters 90, 92 and one or more of communication means 94, 96 98, 100, 102, and where the signals directly represent downhole conditions monitored by the sensors $86_{1,2}$, $88_{1,2}$, or include data representing the conditions. An evaluation of the downhole conditions is performed and the downhole conditions are compared to expected conditions downhole. Expected conditions in one example are from historical data which is that available from a temperature gradient and optionally also pressure data which is estimated based upon static head of the fluids within the wellbore 12, in one example fluids whose static head values are estimated include drilling mud 50, spacer fluid 48, cement slurry 18, displacement fluid 56 and combinations thereof. In a further example, if variances between the measured downhole conditions and the expected conditions exceed a designated value, subsequent remedial action is taken to address the situations. In one example of a remedial action the constituents of the cement slurry 18 are adjusted so that a design condition of the cement slurry 18 exceeds that of the monitored downhole conditions. In an alternative, pressure drop through the shoe track 58 is optionally obtained by comparison of the downhole conditions monitored by the sensors $86_{1,2}$, versus that of sensors $88_{1,2}$.

Figure 5:
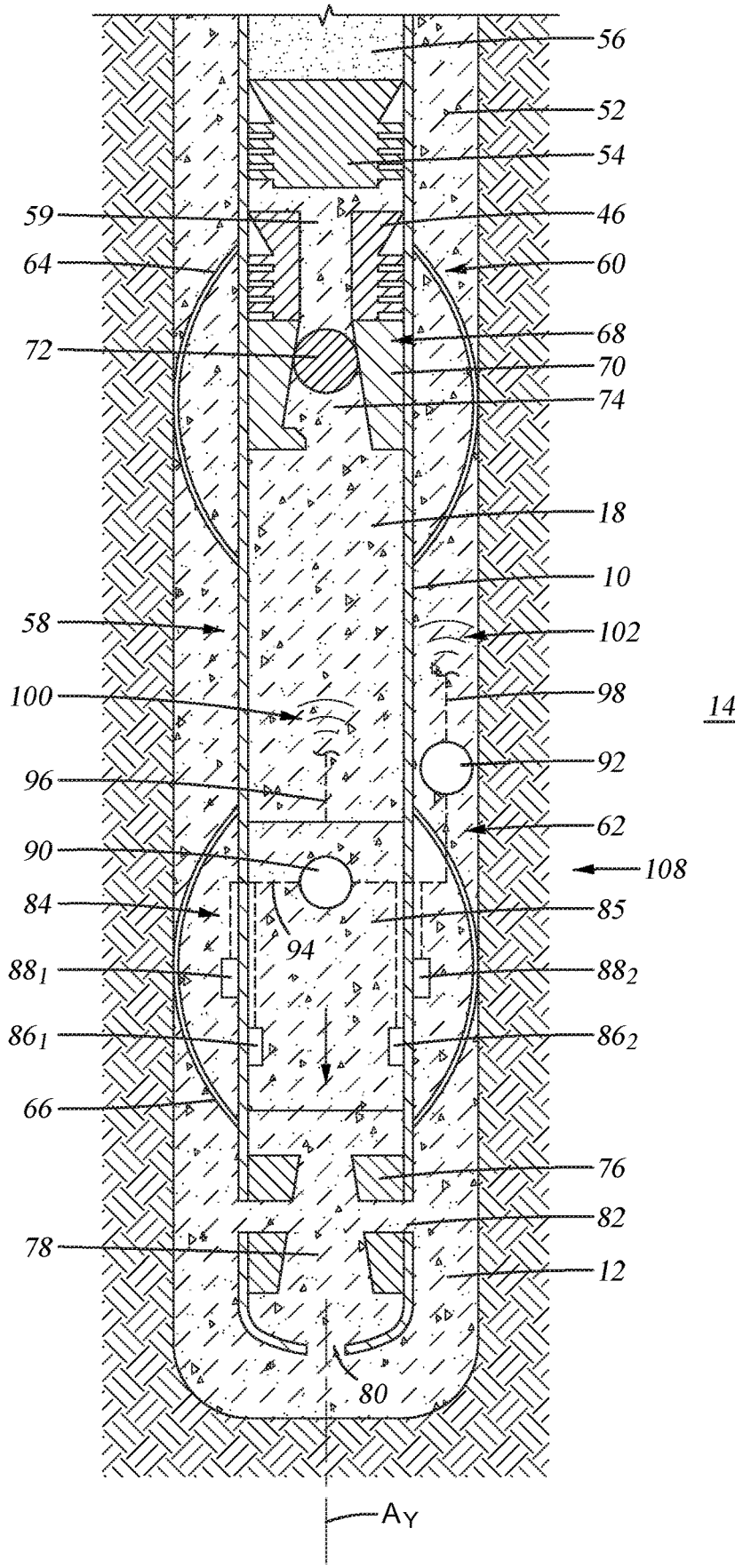
FIG. 5 is a side sectional view of the portion of FIG. 4 with set cement formed around the portion.

Referring now to FIG. 5 shown is an example step of the cementing operations described herein, and where the cement slurry 18 of FIG. 4 has cured into a set cement 104 within annulus 52 and inside of a portion of shoe track 58 below float collar 60. In this example, the presence of the set cement 104 is detectable with an evaluation of the pressure downhole and which is sensed by the sensors $86_{1,2}$, $88_{1,2}$ and transmitted uphole by transmitters 90, 92. In a further example, acoustic signals 100, 102 generated by transmitters 90, 92 are received on surface S and where values of conditions monitored downhole by sensors $86_{1,2}$, $88_{1,2}$ are extracted. Optionally, signals 100, 102 are analyzed, and characteristic(s) of the signals obtained from the analysis provides information about the cement slurry 18 or set cement 104. Example characteristic(s) include speed, attenuation, and travel time, which in certain embodiments vary dependent upon the medium in which the signals 100, 102 are being transmitted. In an embodiment, the values of downhole conditions obtained from the data embedded in the signals is further conditioned or adjusted based on the characteristic(s) of the signals analyzed. In yet another example, information about a quality of the set cement 104 is obtained by an analysis of the signals 100, 102 and their characteristic(s). In a non-limiting example, an analysis of changes in the characteristic(s) of the signals 100, 102 over time is performed that indicates when the cement slurry 18 has cured into set cement 104.

Still referring to FIG. 5 shown is that the plug member 74 is moved into a smaller cross-sectional area of passage 72 and which blocks fluid flow uphole through the float collar 60. In an alternative, a transmitter receiver device 106 is shown mounted within wellhead assembly 30 of FIG. 1, and which is in communication with transmitters 90, 92 or optionally directly within sensors $86_{1,2}$, $88_{1,2}$ and via repeater (not shown) disposed within or along outside of casing string 10 and that deliver signals to the receiver transmitter 106. In one alternative, the combination of the sensors $86_{1,2}$, $88_{1,2}$ transmitters 90, 92 communication means 94, communication lines 96, 98 and receiver transmitter 106 define an example of a monitoring system 108.

Advantages provided by this disclosure include addressing concerns surrounding the shoe track 58 before, during, and after cementing operations. Having accurate temperature values proximate the shoe track 58 enables adjustment of design temperatures of the cement slurry 18 and set cement 104 by introducing additives; and which provides an alternative in examples when the measured temperature around the shoe track 58 differs from a temperature based on a common temperature gradient for the field that was historically gathered through some common temperature logs run in the field. In an example, values of pressure sensed around the shoe track 58 are compared with theoretical planned pressures; which provides an option of adjusting operations should these values differ. The ability to adjust composition of the cement slurry 18 based on actual sensing of downhole conditions increases the likelihood that the set cement 104 meets or exceeds design values and functionality. A further advantage provided includes the availability of wait on cement ("WOC") times between stages in case of multi stage cementing operations and wet shoe track issues by sensing the internal pressure across the shoe track 58, as pressure exerted by the set cement 104 is expected to be less than that exerted by the cement slurry 18 in the annulus 52. Also the height of the column of cement slurry 18 in the annulus 52 is readily obtained by the real time pressure measurements. Advantages also include confirming that the equipment in the shoe track 58 is holding (i.e. preventing a back flow of cement slurry 18 from annulus 52 back into shoe track 58) after bleeding off pressures at the end of the cementing operations.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of cementing a wellbore comprising:

flowing a cement slurry into a casing string that is disposed in the wellbore;

urging the cement slurry from an end of the casing string and into an annulus between the casing string and walls of the wellbore;

obtaining real time downhole conditions of the cement slurry by monitoring conditions of the cement slurry proximate the end;

transmitting acoustic signals uphole that have data comprising values representing the real time downhole conditions, adjusting the values representing the real time downhole conditions based on characteristics of the acoustic signals to obtain adjusted values; and adjusting a property of the cement slurry based on the adjusted values by selectively introducing one or both of an additive or a cement slurry constituent to the cement slurry.

2. The method of claim 1, wherein the conditions include pressure and temperature.

3. The method of claim 1, wherein the conditions are monitored inside and outside of a shoe track that is disposed on a lower end of the casing string.

4. The method of claim 3, wherein the conditions are pressure and the method further comprising identifying a pressure differential of cement slurry flowing through the shoe track.

5. The method of claim 1, further comprising evaluating a characteristic of the acoustic signals, wherein the characteristic is selected from the group consisting of speed, attenuation, and travel time.

6. The method of claim 5, further comprising obtaining the values of downhole conditions from the data.

7. The method of claim 5, further comprising estimating a property of the cement slurry based on a characteristic of the acoustic signal and the monitored conditions.

8. The method of claim 1, further comprising comparing the monitored conditions to expected conditions, and adjusting a design temperature of the cement slurry when the monitored conditions differ from the expected conditions by an amount that exceeds a designated amount, and wherein the additive adjusts the design temperature of the cement slurry.

9. The method of claim 5, further comprising determining that the cement slurry has cured into a set cement based on observing a change over time of characteristics of the signals analyzed.

10. The method of claim 3, further comprising evaluating the holdup of a column of the cement slurry by the shoe track based on an evaluation of the real time downhole conditions.

11. The method of claim 10, further comprising conducting a downhole intervention to repair the shoe track when no holdup of the column of the cement slurry by the shoe track is determined.

12. A system for cementing a wellbore comprising:

a casing string;

a shoe track mounted on an end of the casing string that receives cement slurry selectively injected into the casing string;

a monitoring system disposed in the shoe track that is sensitive to downhole conditions proximate the shoe track;

a means for, (a) receiving an acoustic signal with embedded data representing the downhole conditions and (b) adjusting the data based on a characteristic of the acoustic signal; and a means for evaluating that a variance between a downhole temperature and an expected downhole temperature exceeds a designated amount, and for adding an additive to the cement slurry to change a design temperature of the cement slurry to be at least that of the downhole temperature.

13. The system of claim 12, wherein the means comprises a controller that is in communication with the monitoring system.

14. The system of claim 12, wherein the monitoring system comprises sensors that are inside and outside of the shoe track.

15. The system of claim 13, wherein the monitoring system comprises a sensor that senses the downhole conditions and a transmitter in communication with the sensor.

16. The system of claim 15, wherein the transmitter comprises a first transmitter that is disposed inside the shoe track and the sensor comprises a first sensor that is disposed inside the shoe track, and wherein a second sensor and a second transmitter are disposed outside the shoe track.

17. The system of claim 16, wherein the controller is in communication with the first and second transmitters, and based on a comparison of signals received from the first and second transmitters selectively evaluates characteristics of substances inside the casing string and in an annulus between the casing string and the wellbore.

18. A method of cementing a wellbore comprising:

flowing a cement slurry into a casing string that is disposed in the wellbore;

urging the cement slurry from an end of the casing string and into an annulus between the casing string and walls of the wellbore;

monitoring conditions of the cement slurry proximate the end to obtain monitored conditions;

transmitting acoustic signals from within the wellbore, the signals having data representing the monitored conditions;

receiving the acoustic signals proximate an upper end of the casing string;

analyzing characteristics of the acoustic signals that are selected from the group consisting of speed, attenuation, and travel time;

extracting values of the conditions monitored downhole from the received signals;

adjusting the values of the conditions monitored downhole based on the characteristics analyzed; and based on the adjusted values, adjusting a composition of the cement slurry by selectively introducing one or both of an additive or a cement slurry constituent.

19. The method of claim 18, further comprising monitoring conditions downhole and determining that the cement slurry has become set cement based on a change over time of one of the characteristics analyzed.

* * * * *